US005180154A

United States Patent [19]

Malick

[11] Patent Number: 5,180,154

[45] Date of Patent: Jan. 19, 1993

[54] METHOD AND APPARATUS FOR CHANGING THE DIRECTION OF MOTION OF FLAT ARTICLES

[75] Inventor: Shahzad H. Malick, Fairfield, Conn.

[73] Assignee: Pitney Bowes Inc., Stamford, Conn.

[21] Appl. No.: 880,467

[22] Filed: May 5, 1992

Related U.S. Application Data

[63] Continuation of Ser. No. 608,512, Nov. 2, 1990, abandoned.

[51] Int. Cl.[5] ..... B65H 5/00

[52] U.S. Cl. ..... 271/2; 271/184; 271/225; 271/250; 198/412; 198/457

[58] Field of Search ..... 271/2, 184, 185, 248, 271/225, 250, 251, 252; 198/456, 457, 624, 787, 412

[56] References Cited

U.S. PATENT DOCUMENTS

| | | | |
|---|---|---|---|
| 3,279,290 | 10/1966 | Stemmler | 271/225 |
| 4,527,792 | 7/1985 | Burkhardt | 271/184 X |
| 4,572,350 | 2/1986 | Besemann | 198/457 X |
| 4,726,461 | 2/1988 | Pokrinchak | 198/583 X |
| 4,879,571 | 11/1989 | Plasscheart | 271/225 X |
| 4,909,374 | 3/1990 | Skrypalle | 198/624 X |

FOREIGN PATENT DOCUMENTS 60-258041 12/1985 Japan .

*Primary Examiner*—Joseph E. Valenza
*Assistant Examiner*—Tuan N. Nguyen
*Attorney, Agent, or Firm*—Charles R. Malandra, Jr.; Melvin J. Scolnick

[57] ABSTRACT

An apparatus and method for changing the direction of motion of flat articles being conveyed along a first path to a second path. The apparatus comprises a deck mounted on a frame. The deck has a first side for receiving an article from a first direction and a second side for conveying the article in a second direction which forms an acute angle equal to or less than forty-five degrees (45°) with the first direction. There is a structure for conveying the article over the deck in the second direction. The conveying structure engages a leading edge of the article only after the article has been disengaged by a conveying structure in the first direction. There is a registration wall positioned downstream from the second direction conveying structure adjacent a third side of the deck. The registration wall extends a third direction whereby the registration wall is at a right angle to the first direction, wherein the leading edge of the article is driven against the registration wall after the article has been disengaged by the second direction conveying structure. There is a structure for conveying the article in the third direction after the article is against said registration wall.

17 Claims, 2 Drawing Sheets

METHOD AND APPARATUS FOR CHANGING THE DIRECTION OF MOTION OF FLAT ARTICLES

This application is a continuation of application Ser. No. 608,512, filed Nov. 2, 1990, now abandoned.

FIELD OF INVENTION

This present invention relates generally to a method and apparatus for changing the direction of motion of flat articles, and in particular to method and apparatus for changing the direction of motion of mailpieces in an inserter machine.

BACKGROUND OF THE INVENTION

Devices are known which turn flat articles, such as letter envelopes, within a plane. These devices are required where envelopes are discharged from an inserter and are not properly oriented to be fed to a downstream device such as a franking machine. An inserter is a machine that places selected items in an envelope for further processing. The filled and sealed envelope is then conveyed to a franking machine to have postage imprinted thereon. Generally, turner devices have the disadvantage of not only having to turn the envelope to have it properly oriented but are also an integral part of the inserting machine.

Examples of devices which turn flat articles are shown in U.S. Pat. Nos. 4,726,461 issued Feb. 23, 1988 to J. Pokrinchak and 4,928,807 issued May 29, 1990 to D. Auerbach, both of which patents are assigned to the assignee of the present invention.

It is known to change the direction of travel for flat articles without changing the orientation of the articles, i.e., without rotating or turning the articles. It is also known that for a one stage right angle change in direction the articles must be stopped in one direction before being conveyed in the right angled direction. Such a device is described in U.S. Pat. No. 4,909,374 issued Mar. 20, 1990 to M. Skrypalle and assigned to the assignee of the present invention.

It is also known that a right angle change of direction for flat articles can be achieved in two or more stages by the use of deflection rollers which change the direction of travel by forty-five degrees (45°) or less at each stage. Such an apparatus and method used in a sorting machine is disclosed in U.S. Pat. No. 4,527,792 issued Jul. 9, 1985 to G. Burkhardt. The Burkhardt apparatus has several limitations which prevent it from being useable in an inserter machine. The apparatus is limited to changing the direction of travel from a path parallel to a long edge of the mailpiece to a path of travel parallel to the short edge thereof. Furthermore, for all sized mailpieces, the Burkhardt apparatus requires a side-justified line of travel along the first direction of travel so that the deflection rollers can engage the article at the right moment to achieve an accurate change in direction. Typically, in an inserter, the center line of travel of the mailpiece is fixed with the side guides being adjustable for handling various sized mailpieces.

Several improvements in the throughput of various upstream modules (such as feeders, accumulators and insert stations) have raised the expectation that the output of the inserter machine will keep up with such improvements. However, when the output is increased on inserters which including conventional turner devices, the turner devices are not maintaining the increased output rate. The turner devices are experiencing various problems when they are operated at higher speeds. For example, inserts are flying out of envelopes before the flap can be closed and turner components are malfunctioning.

SUMMARY OF THE INVENTION

It has been found that a turner device on an inserter machine can be replaced by a right angle transfer device which can operate at the higher throughput rate now required of the inserter machine. The problems experienced when operating a turner device at such higher rates have been eliminated by the use of this right angle transfer device.

An apparatus and method for changing the direction of motion of flat articles being conveyed along a first path to a second path. The apparatus comprises a deck mounted on a frame. The deck has a first side for receiving an article from a first direction and a second side for conveying the article in a second direction which forms an acute angle equal to or less than forty-five degrees (45°) with the first direction. There is a structure for conveying the article over the deck in the second direction. The conveying structure engages a leading edge of the article only after the article has been disengaged by a conveying structure in the first direction. There is a registration wall positioned downstream from the second direction conveying structure adjacent a third side of the deck. The registration wall extends a third direction whereby the registration wall is at a right angle to the first direction, wherein the leading edge of the article is driven against the registration wall after the article has been disengaged by the second direction conveying structure. There is a structure for conveying the article in the third direction after the article is against said registration wall.

The method comprising the steps of feeding a stream of articles along the first path by a first drive means; engaging the leading edge of each of the articles by at least two of a plurality of roller pairs which are configured in at least two parallel rows, each of the roller pairs being angled in a second direction which is equal to or less than forty-five degrees (45°) from the first direction; driving the leading edge of the articles against a registration wall after each of the articles leaves the bite of the roller pairs in the second direction, the registration wall being positioned at a right angle to the first direction and downstream of the roller pairs; and taking each of the articles away by a takeaway roller.

BRIEF DESCRIPTION OF THE DRAWINGS

As shown in the drawings, wherein like reference numerals designate like or corresponding parts throughout the views.

DETAILED DESCRIPTION OF THE PREFERRED EMBODIMENT

Figure 1:
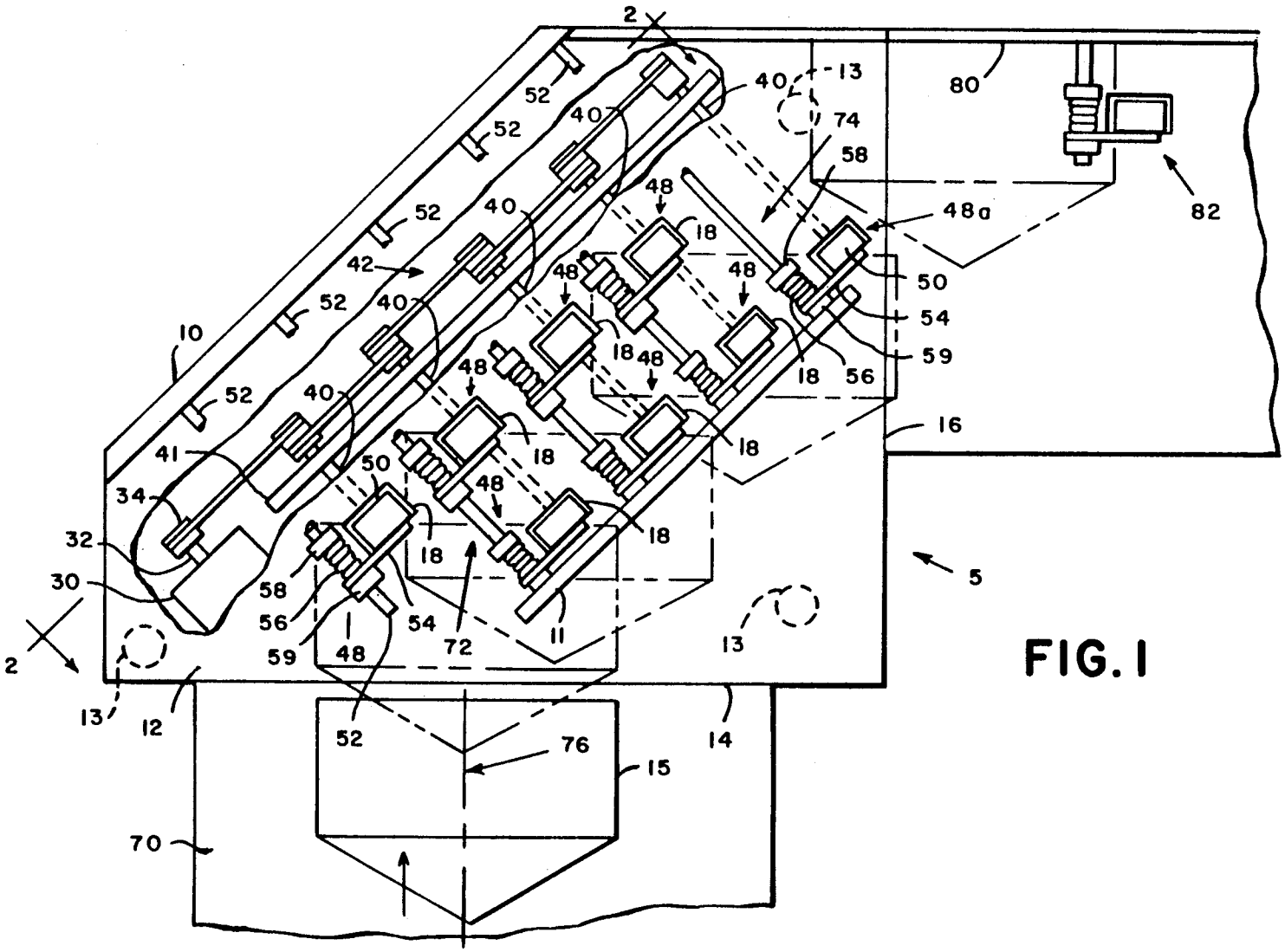
FIG. 1 is a top plan view of the right angle transfer device in accordance with the present invention.
Figure 2:
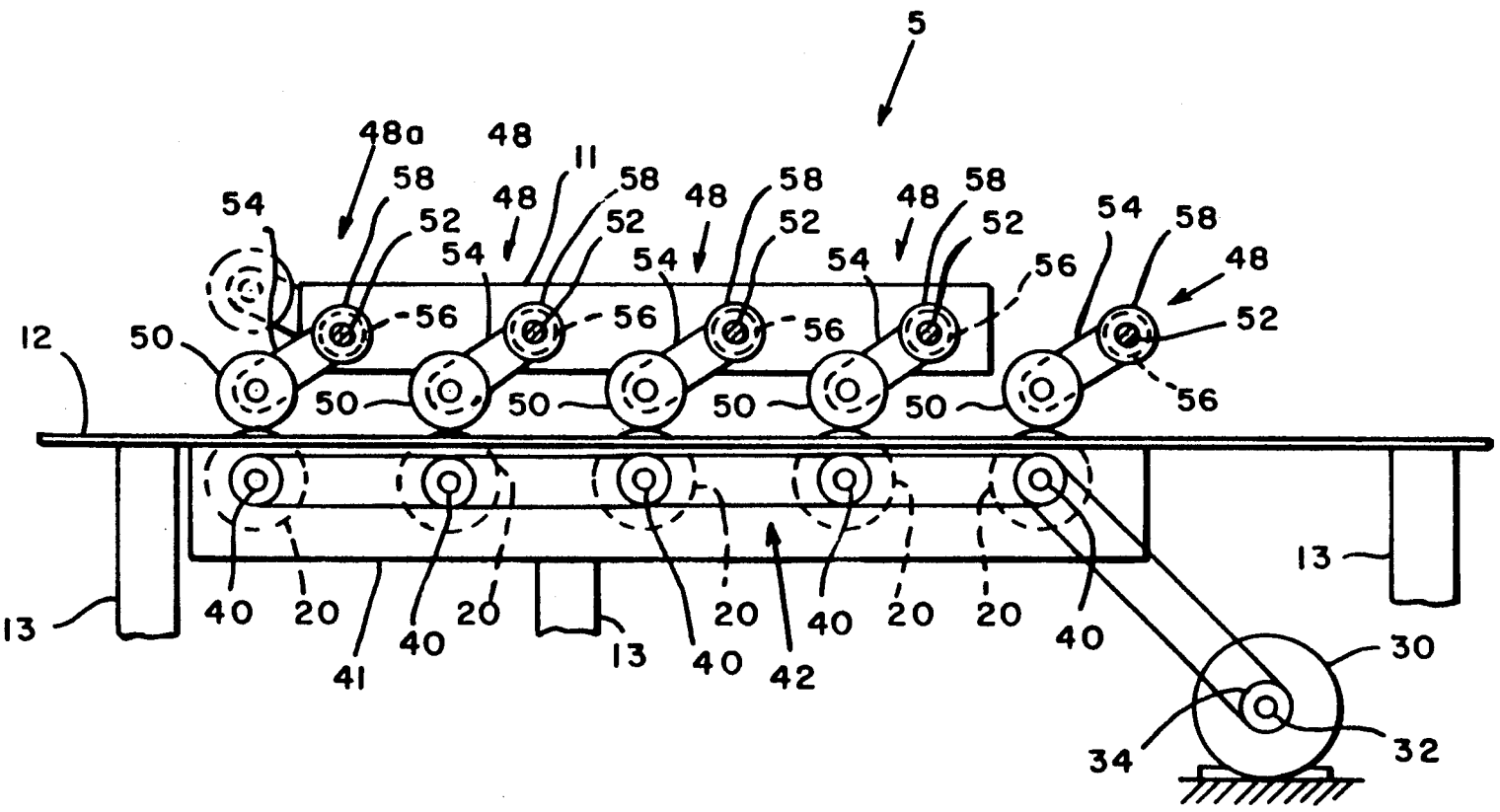
FIG. 2 is side elevational view of the transfer device seen in FIG. 1 along lines 2—2.

Referring now to FIGS. 1 and 2, a flat article direction changing device 5 is shown which includes a plate 10 secured to a deck 12 which is mounted on three leg members 13. Deck 12 has an input side 14 and an exit side 16. The deck is provided with eight rectangular slots 18, each of which has projected in part a continuously driven roller 20. In the preferred embodiment of the present invention, driven rollers 20 have a rubber surface, for example, a urethane surface.

Below deck 12 is a motor 30, preferably a variable speed motor, including shaft 32 on which pulley 34 is fixedly secured. Pulley 34 is operatively connected to drive shafts 40 by a staggered pulley/belt arrangement, generally designated 42, for driving rollers 20. The interior drive shafts 40 each drive two driven rollers 20 and the exterior drive shafts 40 each drive one roller 20. It will be appreciated by those skilled in the art that device 5 can include more than two rollers per shaft depending on the size of the article and the amount of control needed to achieve the right angle change in direction. It will be further appreciated that the orientation of the roller device 5 is not limited to 45 degrees (45°). Any angle less than 45 degrees (45°) can be used to deflect the envelope. When an alternate angle of deflection is employed, the length of the deck and the number of rollers may increase in achieving the right angle change in direction.

Above the deck are eight idler roller assemblies 48 positioned respectively above driven rollers 20. Each idler roller assembly 48 includes a supporting shaft 52 fixably mounted at one end to the plate 10 and at the other end to plate 11 for supporting idler roller assembly 48. This ensures fixed distance among shafts 52. Plate 11 is supported by shafts 52 and is suspended above deck 12. Each assembly 48 includes an idler roller 50 which is rotatably mounted on a pivotable lever arm 54. A torsion spring 56 is mounted on the shaft 52 and is attached at one end to arm 54 and at the other end to a retaining collar 58 also fixably secured to shaft 52. Another retaining collar 59 is used to secure arm 54 to shaft 52. A resultant counter clockwise movement, as viewed in FIG. 2, is therefore applied to each roller 50 and a normal force is applied to corresponding lower, driven roller 20 by the roller 50. In this manner, device 5 can handle envelopes of various thicknesses.

The lower, driven rollers 20 are fixably mounted on drive shafts 40 which are suitably journaled to two plates under deck 12, one of which plates is designated 41, the other is not shown. Although the lower rollers 20 are the driven rollers, the top rollers 50 could be driven and the bottom rollers 20 could be the idler rollers.

In operation, the right angle transfer device 5 takes a stuffed envelope conveyed from the insert station 70 of an inserter machine and changes the direction of travel by ninety degrees (90°) without changing the orientation of the envelope.

In the preferred embodiment of the present invention, the speed of the rollers 20 is such that the linear speed of the envelope through the transfer device 5 is slightly less than the exit speed of the envelope from the upstream insert station 70. It has been found that when the envelope is engaged by the first two roller pairs at 72, there is an abrupt jarring which encourages the enclosures to settle to the bottom edge of the envelope.

The exit speed of the envelope from the upstream insert station may vary from job to job and from inserter to inserter. It has been found that using variable speed motor 30, the speed of the rollers 20 on transfer unit 5 can be adjusted accordingly based on any exit speed of the envelope at the insert station 70.

Once the envelope is engaged by the rollers at 72, the envelope travels at a forty-five degree (45°) angle across transfer device 5 until the envelope is released by the last two rollers pairs at 74. The envelope then hits the registration wall 80 and becomes engaged by takeaway roller assembly 82 at the same linear speed. As seen in FIG. 1, the orientation of the envelope is maintained as the envelope travels through the transfer device 5.

The position of registration wall 80 is adjustable for handling different sized envelopes. Wall 80 is positioned such that envelope 15 does not make contact with wall 80 until the envelope leaves the control of the last pair of rollers at 74. Roller assembly 82 is adjustably positioned along registration wall 80 to ensure that the envelope is not engaged until it leaves the control of the last pair of rollers at 74.

As previously stated, the present invention can be used at new inserter speeds, for example, 9600 cycles/hr. It will be appreciated by those skilled in the art that the rollers provide a constant positive drive of the envelope, and eliminate the abrupt mechanical rotation typically associated with turners in this area of the inserter machine.

It has been found that engaging the envelope at all times by two or more rollers provides a steady positive drive through transfer device 5 and therefore, provides better control of the envelope travelling at such high speeds.

It has also been found that engaging the envelopes by only one directional drive at a time further provides better control at such high speeds. In the preferred embodiment of the present invention, envelope 15 is not engaged by the rollers in transfer device 5 until the envelope has been released by the drive means exiting insert station 70. Envelope 15 is not engaged by takeaway roller assembly 82 until envelope 15 has been released by the rollers in transfer device 5.

FIG. 2 shows the downstream idler roller 50 in a raised position in phantom to show that the idler rollers 50 can be raised to provide an alternative method for accommodating different sized envelopes. For example, the idler roller 50 of roller assembly 48*a*, may be raised to ensure that the envelope 15 is not engaged by any roller assembly when envelope 15 hits wall 80.

The transfer device 5 shown in FIGS. 1 and 2 performs a change in direction to the right. It will be appreciated by those skilled in the art that a transfer device configured in the mirror image of device 5 will perform a change in direction to the left.

Because of the configuration of inserters, the center line 76 of envelope 15 is fixed leaving the insert station 70. It will be appreciated by those skilled in the art that, regardless of size of envelopes, the center line of any envelope conveyed from the insert station 70 will always be engaged at the same point 72 in transfer device 5.

In the preferred embodiment of the present invention, transfer device 5 is independently driven and controlled and is not an integral part of the inserter machine. Transfer device 5 includes its own drive motor 30. Once transfer device 5 is turned on, driven rollers 20 can be continuously driven independent of the starting, stopping and interruption in the operation of the inserter machine.

It will be appreciated by those skilled in the art that there as now been described an apparatus and method for performing a right angle change in the direction of motion of flat articles. Although this invention has been described in conjunction with a specific embodiment thereof, many alternatives, modifications and variations will be apparent to those skilled in the art. Accordingly, it is intended to embrace all such alternatives, modifications and variations that follow within the spirit and scope of the appended claims.

What is claimed is:

1. An apparatus for changing the direction of travel of a flat article along a single path, comprising:

a deck mounted on a frame, said deck having a first side for receiving an article from a first direction along a single path and a second side for conveying the article in a second direction along said single path which forms an acute angle equal to or less than forty-five degrees (45°) with the first direction;

means for conveying the article over said deck in said second direction;

a registration wall fixedly positioned downstream from said second direction conveying means adjacent a third side of said deck, said registration wall extending a third direction along said single path whereby said registration wall is at a right angle to the first direction, wherein said leading edge of the article is driven against said registration wall after the article has been disengaged by said second direction conveying means; and means for conveying the article in said third direction after said article is against said registration wall.

2. The apparatus according to claim 1, wherein said second direction conveying means comprise a plurality of roller pairs, each of said roller pairs being positioned in line with said second direction.

3. The apparatus according to claim 1, wherein said second direction is forty-five degrees (45°) from said first direction.

4. The apparatus according to claim 1, wherein said third direction is ninety degrees (90°) from said first direction.

5. The apparatus according to claim 2, wherein each of said roller pairs includes a spring biased idler roller assembly and a driven roller.

6. The apparatus according to claim 5, wherein said driven rollers are driven at an adjustable speed by a variable speed motor.

7. The apparatus according to claim 6, wherein said driven roller speed is less than a speed of said first direction conveying means.

8. The apparatus according to claim 6, wherein the control of said second direction conveying means is independent of the control of an inserter in which the apparatus is configured.

9. The apparatus according to claim 5, wherein each of said idler rollers is pivotable for disengaging any combination of roller pairs so that when the article is being conveyed by said second direction conveying means, said first and third direction conveying means are not engaging the article.

10. The apparatus according to claim 1, wherein said registration wall is adjustably positioned to handle various sized articles.

11. A method for changing the direction without changing the orientation of motion of flat articles being conveyed along a first direction to a third direction which is at a right angle to the first direction, the method comprising the steps of:

a) feeding a stream of articles along the first direction by a first drive means;

b) engaging the leading edge of each of said articles by at least two of a plurality of roller pairs, said roller pairs being configured in at least two parallel rows, each of said roller pairs being angled in a second direction which is equal or less than forth-five degrees (45°) from said first direction;

c) conveying each of the articles by the rollers pairs across a deck in the second direction;

d) driving said leading edge of the articles against a registration wall after each of the articles have been disengaged by the roller pairs in the second direction, said registration wall being positioned at a right angle to the first direction and downstream of the roller pairs; and e) conveying each of the articles along the registration wall by a third drive means.

12. The method according to claim 11, further comprising the step of:

independently controlling and driving the roller pairs from the first and third drive means.

13. The apparatus according to claim 1, wherein the said first direction conveying means is situated at a downstream end of an insert station in an inserter machine and the article being conveyed is an envelope having enclosures inserted therein, and wherein the speed of said second direction conveying means is less than the speed of the first direction conveying means whereby the enclosures in the envelope towards the bottom of the envelope when the envelope is engaged by said second direction conveying means.

14. In an inserter, an apparatus for changing the direction of travel of documents without changing the orientation of the documents, the documents including sheets of paper, inserts an envelopes, comprising:

a deck mounted on a frame, said deck having a first side for receiving a document being fed from a first direction and a second side for conveying the document in a second direction which forms an acute angle equal to or less than forth-five degrees (45°) with the first direction;

means operatively connected to said deck for conveying the document over said deck in said second direction, said second direction conveying means engaging the leading edge of the document which has been fed to said deck by a means for conveying the document in the first direction, whereby the orientation of the document being conveyed in the first direction is maintained when the document is conveyed in the second direction;

a registration wall positioned downstream from said second direction conveying means, said registration wall being adjacent a third side of said deck and extending a third direction, wherein said leading edge of the document is driven against said registration wall by momentum after the document is conveyed beyond said second direction driving means; and means for conveying the document in said third direction after said article has been driven against said registration wall.

15. The apparatus according to claim 14, wherein said second direction conveying means comprise a plurality of roller pairs, each of said roller pairs being positioned in line with said second direction.

16. The apparatus according to claim 15, wherein each of said roller pairs includes a spring biased idler roller assembly and a driven roller.

17. The apparatus according to claim 1, wherein said registration wall is adjustably positioned to handle various sized envelopes.

* * * * *